US009496610B2

(12) United States Patent
Blech

(10) Patent No.: US 9,496,610 B2
(45) **Date of Patent: *Nov. 15, 2016**

(54) OPTICALLY CONTROLLED MICROWAVE ANTENNA

(75) Inventor: Marcel Daniel Blech, Herrenberg (DE)

(73) Assignee: Sony Corporation, Tokyo (JP)

( * ) Notice: Subject to any disclaimer, the term of this patent is extended or adjusted under 35 U.S.C. 154(b) by 652 days.

This patent is subject to a terminal disclaimer.

(21) Appl. No.: 13/980,465

(22) PCT Filed: Dec. 21, 2011

(86) PCT No.: PCT/EP2011/073564

§ 371 (c)(1),
(2), (4) Date: Jul. 18, 2013

(87) PCT Pub. No.: WO2012/100885

PCT Pub. Date: Aug. 2, 2012

(65) Prior Publication Data

US 2013/0293436 A1 Nov. 7, 2013

(30) Foreign Application Priority Data

Jan. 25, 2011 (EP) ..... 11152055

(51) Int. Cl.
*H01Q 13/00* (2006.01)
*H01Q 3/26* (2006.01)
(Continued)

(52) U.S. Cl.
CPC ..... *H01Q 3/26* (2013.01); *H01P 1/182* (2013.01); *H01Q 3/2676* (2013.01); *H01Q 15/147* (2013.01); *H01Q 15/148* (2013.01)

(58) Field of Classification Search
CPC ..... H01Q 19/06; H01Q 3/26; H01Q 15/00; H01Q 15/002; H01Q 3/2676
USPC ..... 343/754, 753, 755, 772, 776, 876, 777
See application file for complete search history.

(56) References Cited

U.S. PATENT DOCUMENTS 3,259,902 A 7/1966 Malech
4,751,513 A 6/1988 Daryoush et al.
(Continued)

FOREIGN PATENT DOCUMENTS

CN 101911384 A 12/2010
EP 0 595 726 5/1994
(Continued)

OTHER PUBLICATIONS

Combined Search Report and Office Action issued Jun. 11, 2014 in Chinese Patent Application No. 201180066041.5 (with partial English translation).
(Continued)

*Primary Examiner* — Hoanganh Le
(74) *Attorney, Agent, or Firm* — Oblon, McClelland, Maier & Neustadt, L.L.P.

(57) ABSTRACT

An optically controlled microwave antenna that reduces optical power consumed by the antenna. The optically controlled microwave antenna includes an antenna array including plural antenna elements and a feed for illuminating the antenna array with and/or receiving microwave radiation of the operating frequency from the antenna array to transmit and/or receive microwave radiation. An antenna element includes a waveguide, an optically controllable semiconductor element arranged within the waveguide in front of a light transmissive portion of a second end portion, the semiconductor element changing its material properties under control of incident light, and a controllable light source arranged at or close to the light transmissive portion of the second end portion for projecting a controlled light beam onto the semiconductor element for controlling its material properties, in particular its reflectivity.

29 Claims, 16 Drawing Sheets

(51) Int. Cl.
*H01P 1/18* (2006.01)
*H01Q 15/14* (2006.01)

(56) References Cited

U.S. PATENT DOCUMENTS

| | | | | |
|---|---|---|---|---|
| 5,148,182 | A | 9/1992 | Gautier et al. | |
| 5,579,015 | A * | 11/1996 | Collignon | H01Q 3/46 342/375 |
| 5,835,062 | A | 11/1998 | Heckaman et al. | |
| 5,847,672 | A | 12/1998 | James | |
| 6,313,803 | B1 | 11/2001 | Manasson et al. | |
| 6,621,459 | B2 | 9/2003 | Webb et al. | |
| 9,166,290 | B2 * | 10/2015 | Blech | H01Q 3/2676 |
| 2007/0252768 | A1 | 11/2007 | Mohamadi | |
| 2008/0238795 | A1 * | 10/2008 | Alamouti | H01Q 3/2658 343/768 |
| 2011/0180661 | A1 | 7/2011 | Weaver | |

FOREIGN PATENT DOCUMENTS

| | | |
|---|---|---|
| GB | 2 318 011 | 4/1998 |
| GB | 2 406 718 | 4/2005 |
| JP | 63 269807 | 11/1988 |

OTHER PUBLICATIONS

U.S. Appl. No. 13/708,233, filed Dec. 7, 2012, Blech.

U.S. Appl. No. 13/706,853, filed Dec. 6, 2012, Blech.

Huang, J., et al., "Reflectarray Antennas", IEEE, Total 227 pages, (2008).

Hajian, M., et al., "Electromagnetic Analysis of Beam-Scanning Antenna at Millimeter-Wave Band Based on Photoconductivity Using Fresnel-Zone-Plate Technique", IEEE Antennas and Propagation Magazine, vol. 45, No. 5, pp. 13- 25, (Oct. 2003).

Chang, C.C., et al., "A millimeter wave beam shaping phased antenna array proposed for imaging reflectometry", URL: http://ieeexplore.ieee.org/xpl/freeabs_all.jsp?arnumber=1228749, Total 2 pages, (Jun. 2-5, 2003).

International Search Report Issued Jun. 6, 2012 in PCT/EP11/073564 Filed Dec. 21, 2011.

* cited by examiner 202
218
102
212
203
215
214
208
214
215

218
215
206
234
235
207
215
203
202
214
210
214

102
118
104
208
132
106
218
222

106
132
208

302
418
102
212
203
215
214
215
214

418
215
234
235
215
203
216
302
214
209
210
214
102
118
209
217
132
106

418
222

106
132
209

OPTICALLY CONTROLLED MICROWAVE ANTENNA

FIELD OF THE DISCLOSURE

The present disclosure relates to an optically controlled microwave antenna. Further, the invention disclosure relates to an antenna array, in particular for use in such an optically controlled antenna, comprising a plurality of antenna elements. Still further, the present disclosure relates to control circuit for controlling light sources of an antenna array of a microwave antenna.

BACKGROUND OF THE DISCLOSURE

In millimeter wave imaging systems a scene is scanned in order to obtain an image of the scene. In many imaging systems the antenna is mechanically moved to scan over the scene. However, electronic scanning, i.e. electronically moving the radiation beam or the sensitivity profile of the antenna, is preferred as it is more rapid and no deterioration of the antenna occurs like in a mechanic scanning system.

Reflectarray antennas are a well-known antenna technology, e.g. as described in J. Huang et J. A. Encinar, Reflectarray Antennas, New York, N.Y., USA: Institute of Electrical and Electronics Engineers, IEEE Press, 2008, used for beam steering in the microwave and millimeter waves frequency range (hereinafter commonly referred to as "microwave frequency range" covering a frequency range from at least 1 GHz to 30 THz, i.e. including mm-wave frequencies). For frequencies up to 30 GHz there exist multiple technologies to control the phase of each individual antenna element of such a reflectarray antenna having different advantages and disadvantages. In particular PIN diode based switches suffer from a high power consumption, high losses and can hardly be integrated into a microwave antenna operating above 100 GHz. MEMS switches require high control voltages and have very slow switching speed. FET-based switches suffer from high insertion losses and require a large biasing network. Liquid crystal based phase shifters exhibit very slow switching speeds in the order of tenths of a second. Ferroelectric phase shifters allow rapid shifting at low power consumption, but have a significant increase in loss above 60 GHz.

Optically controlled plasmonic reflectarray antennas are described, for instance, in U.S. Pat. No. 6,621,459 and M. Hajian et al., "Electromagnetic Analysis of Beam-Scanning Antenna at Millimeter-Waves Band Based on Photoconductivity Using Fresnel-Zone-Plate Technique", IEEE Antennas and Propagation Magazine, Vol. 45, No. 5, October 2003. Such reflectarray antennas have, however, a very high power consumption. Particularly, U.S. Pat. No. 6,621,459 discloses a plasma controlled millimeter wave or microwave antenna in which a plasma of electrons and holes is photo-injected into a photoconducting wafer. In a first embodiment the semiconductor is switched between the material states "dielectric" and "conductor" requiring a high light intensity and providing a high antenna efficiency. In a second embodiment the semiconductor is switched between the two states "dielectric" and "absorber (lossy conductor)" requiring only a low light intensity and providing a worse antenna efficiency. A special distribution of plasma and a millimeter wave/microwave reflecting surface behind the wafer allows a phase shift of the individual elements of 180° between optically illuminated and non-illuminated elements in the first embodiment. The antenna can be operated at low light intensities using a mm-wave/microwave reflecting back surface with an arbitrary constant phase shift between illuminated and non-illuminated elements in said second embodiment.

In an embodiment the antenna includes a controllable light source including a plurality of LEDs arranged in an array and a millimeter wave reflector positioned in front of the light source, said reflector allowing light from the light source to pass there through while serving to reflect incident millimeter wave radiation. Further, an FZP (Fresnel Zone Plate) wafer is positioned in front of the millimeter wave reflector, said wafer being made a photoconducting material which is transmissive in the dark to millimeter waves and is responsive in the light. Finally, the antenna includes an antenna feed located in front of the wafer for illuminating the wafer with millimeter waves and/or receiving millimeter waves. By selectively illuminating the LEDs, heavy plasma density produces a 180° phase shift in out-of-phase zones. With respect to those regions where the LEDs are not illuminated, low plasma density (or "in-phase") zones are provided. Millimeter wave radiation which is incident on the high plasma density zones incurs a 180° phase change on reflection at the front surface of the wafer. Comparatively, millimeter wave radiation which is incident on the low plasma density zones incurs a 180° phase change on reflection at the millimeter wave reflector. The path length difference provides the desired overall phase shift of 180° between in-phase and out-of-phase zones. In an alternative embodiment described in this document the reflectivity of the wafer to reflect millimeter wave radiation is changed by the illumination of the light source to either allow the millimeter wave radiation to be reflected or to pass through. In another embodiment using lower light intensities the mm-wave radiation can either be absorbed by the wafer or pass through.

BRIEF SUMMARY OF THE DISCLOSURE

It is an object of the present disclosure to provide an optically controlled microwave antenna having a lower power consumption compared to known optically controlled microwave antennas. It is a further object of the present disclosure to provide a corresponding antenna array for use in such an optically controlled microwave antenna and to provide a control circuit for controlling light sources of an antenna array of a microwave antenna.

According to an aspect of the present disclosure there is provided an optically controlled microwave antenna comprising:

i) an antenna array comprising a plurality of antenna elements, an antenna element comprising:

- a waveguide for guiding microwave radiation at an operating frequency between a first open end portion and a second end portion arranged opposite the first end portion, said second end portion having a light transmissive portion formed in at least a part of the second end portion,
- an optically controllable semiconductor element arranged within the waveguide in front of the light transmissive portion of the second end portion, said semiconductor element changing its material properties, in particular its reflectivity of microwave radiation of the operating frequency, under control of incident light, and
- a controllable light source arranged at or close to the light transmissive of portion of the second end portion for projecting a controlled light beam onto said semiconductor element for controlling its material properties, in particular its reflectivity, and ii) a feed for illuminating said antenna array with and/or receiving microwave radiation of the operating frequency from said antenna array to transmit and/or receive microwave radiation.

According to a further aspect of the present disclosure there is provided an antenna array, in particular for use in such an optically controlled antenna, comprising a plurality of antenna elements, an antenna element comprising:

a waveguide for guiding microwave radiation at an operating frequency between a first open end portion and a second end portion arranged opposite the first end portion, said second end portion having a light transmissive portion formed in at least a part of the second end portion, an optically controllable semiconductor element arranged within the waveguide in front of the light transmissive portion of the second end portion, said semiconductor element changing its material properties, in particular its reflectivity of microwave radiation of the operating frequency, under control of incident light, and a controllable light source arranged at or close to the light transmissive portion of the second end portion for projecting a controlled light beam onto said semiconductor element for controlling its material properties, in particular its reflectivity.

Still further, according to an aspect of the present disclosure there is provided a control circuit for controlling light sources of an antenna array, in particular as proposed according to an aspect of the present disclosure, of a microwave antenna, in particular as proposed according to an aspect of the present disclosure, said antenna array comprising a plurality of antenna elements, an antenna element comprising an optically controllable semiconductor element configured to change its material properties, in particular its reflectivity of microwave radiation of the operating frequency, under control of incident light, and a controllable light source for projecting a controlled light beam onto said semiconductor element for controlling its material properties, in particular its reflectivity, said control circuit comprising:

a control unit per light source, a control unit comprising switchable element coupled in parallel to said light source, and a switching element for switching said switchable element on and off under control of a switching element control signal.

Preferred embodiments of the disclosure are defined in the dependent claims. It shall be understood that the claimed antenna array and the claimed control circuit have similar and/or identical preferred embodiments as the claimed optically controlled microwave antenna and as defined in the dependent claims.

The present disclosure is based on the idea to reduce the optical power, which is needed to illuminate the optically controllable semiconductor element used to generate a phase shift in the respective antenna element, by use of an antenna array comprising a plurality of antenna elements in which the antenna elements comprise an open-ended waveguide in which the microwave radiation is guided between a first open end portion and a second end arranged opposite the first end. In the vicinity of said second end portion, which is at least partially open, the optically controllable semiconductor element is placed, preferably in the form of a narrow post (or a grid array of posts as explained below), which semiconductor element changes its material properties, in particular its reflectivity for microwave radiation at the operating frequency, under control of incident light.

For instance, the semiconductor elements may be made of intrinsic semiconductor material, causing a full reflection in case of being illuminated and leading to a change of conductivity from almost 0 S/m to more than 1000 S/m. For illumination of the semiconductor elements controllable light sources are arranged at or close to the light transmissive portion, in particular an opening (or and indium tin oxide layer) of the second end portion of the waveguide, for projecting a controlled light beam onto said semiconductor elements for controlling their reflectivity. As in the known optically controlled microwave antennas such light sources may, for instance, be LEDs, laser diodes, solid state lasers or other means for emitting optical light (visible, IR, or UV) beam.

Like in the known optically controlled microwave antennas a feed is provided for illuminating the antenna array with microwave radiation of the operating frequency to transmit microwave radiation, e.g. for illuminating a scene in an active radiometric imaging system and/or for receiving microwave radiation of the operating frequency from said antenna array to receive microwave radiation, e.g. reflected or emitted from a scene scanned by a (active or passive) radiometric imaging system.

It shall be understood that according to the present disclosure the antenna may be used generally in the frequency range of millimeter waves and microwaves, i.e. in at least a frequency range from 1 GHz to 30 THz. The "operating frequency" may generally be any frequency within this frequency range. When using the term "microwave" herein any electromagnetic radiation within this frequency range shall be understood.

Further, the expression "light source" shall be understood as any source that is able to emit light for illuminating its associated semiconductor element so as to cause the semiconductor element to change its reflectivity to a sufficient extent. Here, "light" preferably means visible light, but also generally includes light in the infrared and ultraviolet range.

It shall also be noted that the proposed optically controlled microwave antenna and the proposed antenna array may be used as reflectarray antenna, i.e. in which embodiment the incident microwave radiation is reflected to the same side of the antenna array. In another embodiment, however, the antenna and the antenna array may be used as a transmissive array antenna in which embodiment the incident microwave radiation is incident on the antenna array on a different side than the output microwave radiation, i.e. the radiation that is transmitted through the waveguides of the antenna array is used as output in this embodiment. In this case the mm-wave signal of the optically illuminated antenna elements is reflected or absorbed. Thus, the antenna aperture efficiency is only approximately 50% of the aforementioned reflectarray.

In rapid optically controlled microwave antennas the semiconductor elements are generally controlled simultaneously, e.g. by a microcontroller or a field-programmable gate array, preferably by individual control lines. This results in an overall high current and a static power consumption of the control circuit. For instance, in case each semiconductor element requires a current of 10 mA a total current of 100 A is required in case of 10000 semiconductor elements in the antenna array which is generally not applicable. Hence, in an aspect of the present disclosure a control circuit is proposed as defined above for controlling the light sources of an antenna array by which the current provided to the individual light sources is reduced to a small fraction of the current used conventionally. Further the total current is strongly reduced resulting in no static power consumption of the control circuit for controlling the light emitting elements such as LEDs or laser diodes.

The proposed control circuit is preferably used in an optically controlled microwave antenna as proposed according to the present disclosure and/or for controlling the light sources of the proposed antenna array. However, generally the proposed control circuit can also be used in other microwave antennas having an antenna array, in which the proposed control circuit can also lead to a significant reduction of the static power consumption of the control circuit of the light sources. Furthermore, less interconnects and wires are needed compared to a solution using a flip-flop for each antenna element.

According to another aspect of the present disclosure an antenna array comprising a plurality of antenna elements is proposed. An antenna element of this antenna array comprises:

- a waveguide for guiding microwave radiation at an operating frequency between a first open end portion and a second end portion arranged opposite the first end portion, said second end portion having an opening formed in at least a part of the second end portion
- an optically controllable semiconductor element arranged within the waveguide in front of the opening of the second end portion said semiconductor element changing its material properties, in particular its reflectivity of microwave radiation of the operating frequency, under control of incident light, and
- a controllable light source arranged at a distance from the opening of the second end portion for projecting a controlled light beam onto said semiconductor element for controlling its material properties, in particular its reflectivity,
- a light focusing element, in particular a dielectric rod and/or a lens, arranged between the light source and the semiconductor element through said opening for focusing the light emitted by the light source to the semiconductor element.

The proposed optically controlled microwave antenna can be scaled to frequencies beyond 500 GHz maintaining low loss (1 dB) and having a reduced power consumption compared to conventional optically controlled microwave antennas, in particular plasmonic reflectarray antennas (80% less).

BRIEF DESCRIPTION OF THE DRAWINGS

These and other aspects of the present disclosure will be apparent from and explained in more detail below with reference to the embodiments described hereinafter. In the following drawings

DETAILED DESCRIPTION OF THE INVENTION

Figure 1:
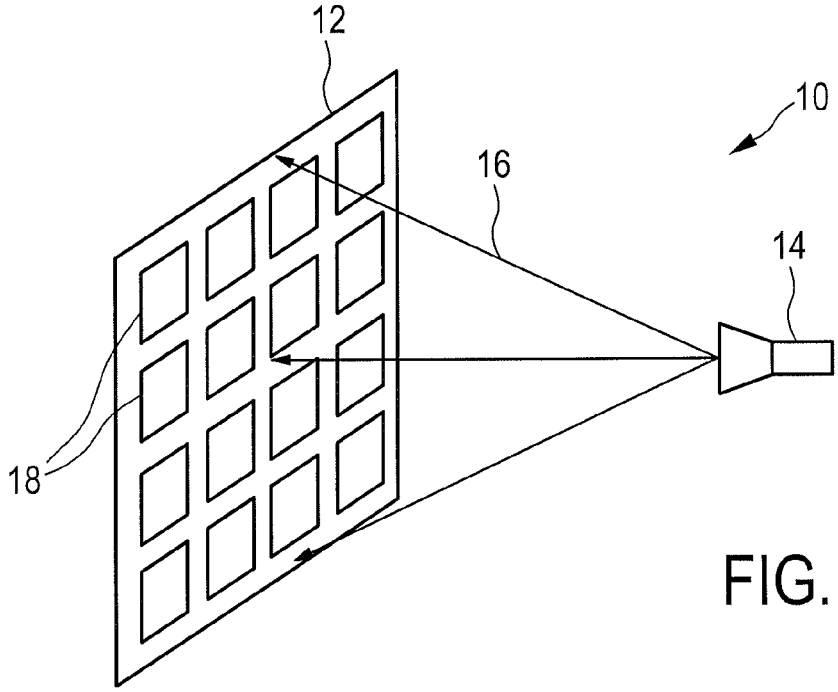
FIG. 1 shows a general embodiment of an optically controlled microwave antenna according to the present disclosure.

FIG. 1 shows a general embodiment of an optically controlled microwave antenna 10 according to the present disclosure. The antenna 10 comprises an antenna array 12 and a feed 14 for illuminating said antenna array with and/or receiving microwave radiation 16 of the operating frequency from said antenna array 12 to transmit and/or receive microwave radiation, for instance to illuminate a scene and/or receive radiation reflected or emitted from a scene to make a radiographic image of the scene. The feed 14 may be a small microwave radiation horn or the like, or may be embodied by a small sub-reflector in case of a Cassegrain or backfire-feed type construction. The feed 14 may be connected (not shown) to a microwave radiation source (transmitter) and/or to a microwave receiver as required according to the desired use of the microwave antenna 10. The antenna array 12 comprises a plurality of antenna elements 18, the reflectivity of which can be individually controlled as will be explained below so that the total antenna beam reflected from or transmitted through the antenna array can be electronically steered to different directions as needed, for instance, to scan a scene. Particularly, the phase of reflected or transmitted microwave radiation of the individual antenna elements 18 can be individually controlled.

Figure 2:
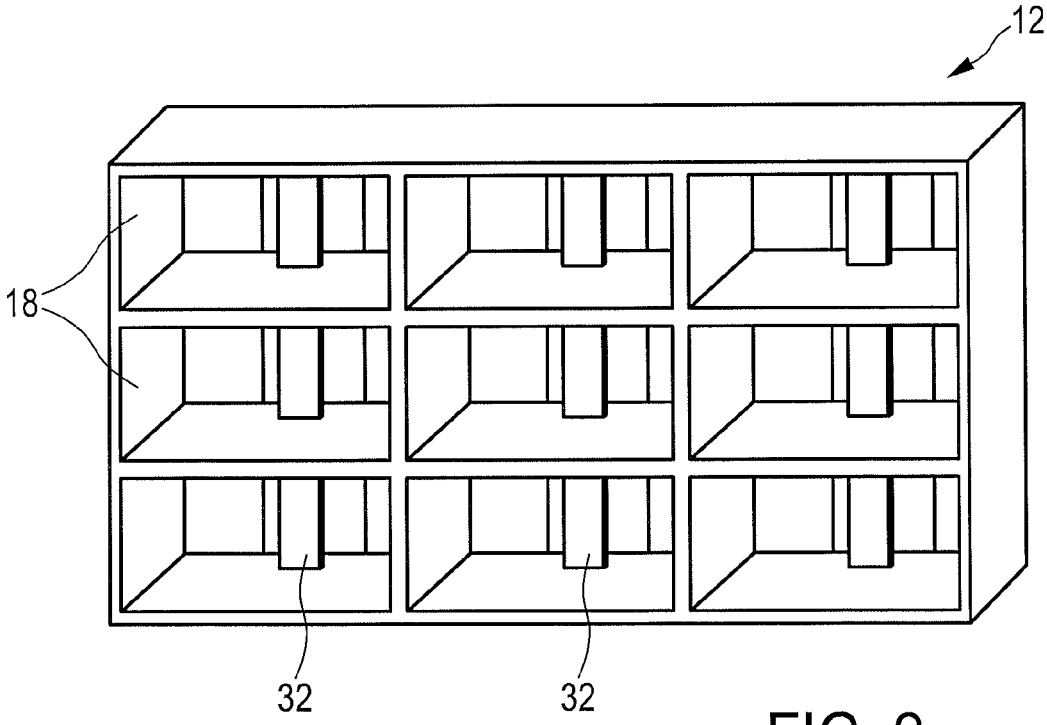
FIG. 2 shows a first embodiment of an antenna array according to the present disclosure.
Figure 3:
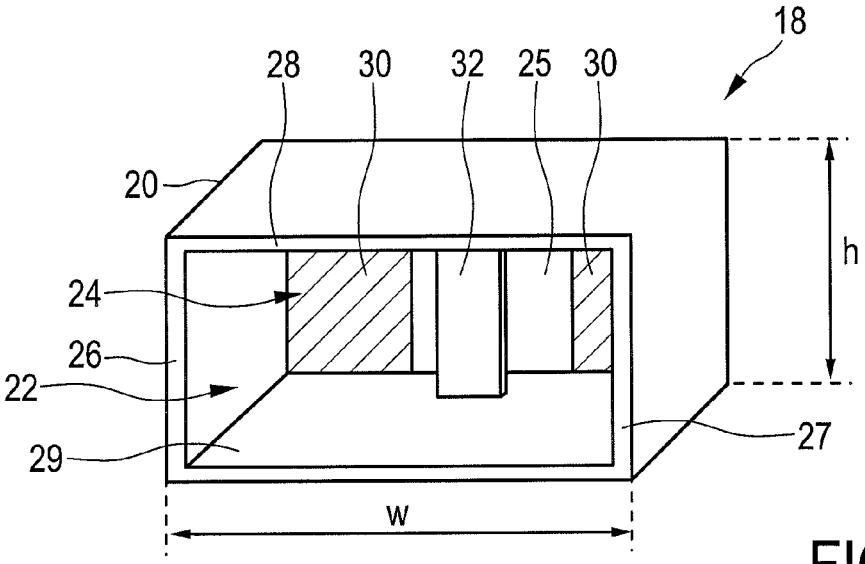
FIG. 3 shows a perspective view of a single antenna element of such an antenna array.

In the embodiment shown in FIG. 1 the antenna elements 18 are regularly arranged along rows and columns of a rectangular grid, which is preferred. However, other arrangements of the antenna elements 18 of the antenna array 12 are possible as well. A perspective view of the antenna array 12 shown in FIG. 1 is depicted in FIG. 2. A single antenna element 18 is depicted in FIG. 3 in a perspective view. The antenna element 18 comprises a waveguide 20 for guiding microwave radiation at an operating frequency between a first open end portion 22 and a second end portion 24 arranged opposite the first end portion 22, said second end portion 24 having an opening 25 (generally a light transmission portion) formed in at least a part of the second end portion 24. The antenna array 12 is preferably arranged such that the first open end portion 22 is facing the feed 14. Preferably, the rectangular waveguide 20 is operated in its fundamental $TE_{10}$ mode.

The waveguide 20 is formed in this embodiment by a tube-like waveguide structure having two opposing left and right sidewalls 26, 27, two opposing upper and lower sidewalls 28, 29 and a back end wall 30, which sidewalls 26 to 30 are preferably made of the same metal material configured to guide microwave radiation.

The antenna element 18 further comprises an optically controllable semiconductor element 32, preferably formed as a post, arranged between and contacting the opposing upper and lower sidewalls 28, 29 of the waveguide 20. The semiconductor element 32 is arranged within the waveguide 20 in front of the opening 25 of the second end portion 24, preferably at a predetermined distance from said opening 25 and closer to said second end portion 24 than to said first end portion 22. Said semiconductor element 32 is configured to change its material properties from dielectric to conductor under control of incident light. For instance, in an embodiment said semiconductor element is able to cause a full reflection within the waveguide 20 in case it is illuminated and to cause no or only low reflection (e.g. full transmission) in case it is not illuminated, i.e. the total reflection changes under control of incident light. Preferably said semiconductor element 32 is made of a photo-conducting material such as elemental semiconductors including silicon and germanium, another member of the category of III-V and II-VI compound semiconductors or graphene.

It should be noted that, while the semiconductor element herein is shown as having the form of a post, the semiconductor element may also have alternative geometries as long as it fulfills the desired function as described herein. Sometimes such an element is also referred to as a controllable short.

Figure 4:
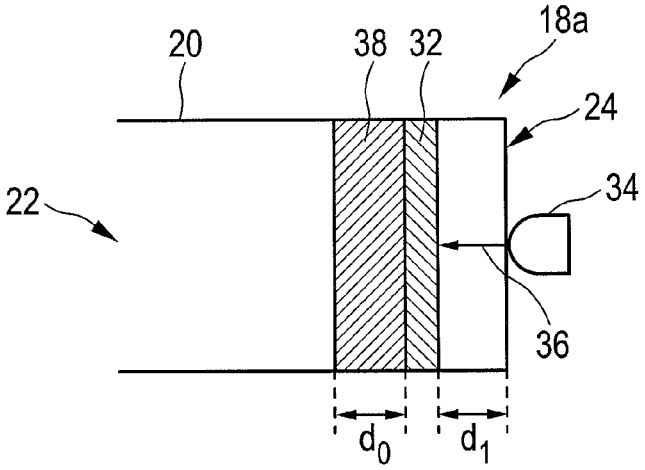
FIG. 4 shows a side view of a first embodiment of a single antenna element.
Figure 5:
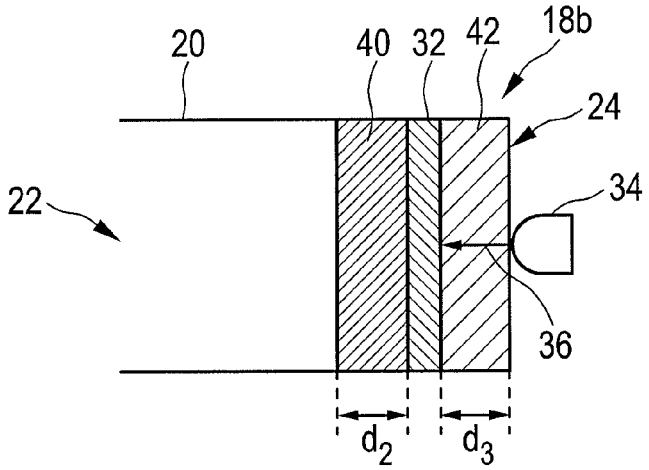
FIG. 5 shows a side view of a second embodiment of a single antenna element.

The antenna element 20 further comprises (not shown in FIGS. 2 and 3 but in FIGS. 4 and 5 showing side views of different embodiments of antenna elements 18*a*, 18*b*) a controllable light source 34 arranged at or close to the opening 25 of the second end portion 24 for projecting a controlled light beam 36 through said opening 25 onto said semiconductor element 32 for controlling its material properties. Due to the change of the material properties of the semiconductor material, the entire antenna element will change the phase of the reflected signal. Said light source 34 may be an LED or a laser diode, but may also include an IR diode or a UV light source in case the semiconductor element 32 is configured accordingly to change its reflectivity in response to incident IR or UV light.

As shown in FIG. 2 the antenna elements 18 are arranged next to each other so that they are sharing their sidewalls. Preferably, the waveguides 20 have a rectangular cross-section having a width w (between the left and right sidewalls 26, 27) of substantially a half wavelength ($0.5\lambda \leq w \leq 0.9\lambda$) and a height h (between the upper and lower sidewalls 28, 29) of substantially a quarter wavelength ($0.25\lambda \leq h \leq 0.4\lambda$) of the microwave radiation of the operating frequency. By use of such a dimensioning of the waveguide 20 it is made sure that only the fundamental $TE_{10}$ mode of the microwaves is guided through the waveguide 20. Further, since only the fundamental $TE_{10}$ mode can propagate within the waveguide, it can be assured that the radiation pattern always looks the same, independent from how homogenous the semiconductor element 32 is illuminated.

As shown in the side view of FIG. 4 the semiconductor element 32 is preferably arranged at a distance $d_1$ from the second end portion 24 of substantially a guided quarter wavelength ($\lambda_g/4$) of the microwave radiation of the operating frequency in case the signal is reflected at the back short of the waveguide. To fix the semiconductor element 32 a support element 38, e.g. a support layer, of a low loss airlike material (e.g. Rohacell) with $\gamma_r \approx 1$ is used. Generally, the thickness $d_0$ of the support element is not essential as long as the losses are negligible, it could e.g. in the same range as the distance $d_1$. Said support element 38 can, as shown in FIG. 4, be arranged on the side of the semiconductor element 32 facing the first end portion 22 but could also be arranged on the side facing the second end portion 24 if it is optically translucent. Preferably, said support element 38 is arranged (contacted) between the upper and lower sidewalls 28, 29 of the waveguide 20.

Alternatively or in addition to the support element 38 one or more antireflection elements 40, 42, for instance dielectric antireflection layers, may be arranged on one or both sides of the semiconductor element 32 as shown in the embodiment of the antenna element 18*b* shown in FIG. 5. Said antireflection elements 40, 42 preferably have a thickness $d_2$, $d_3$ of substantially a guided quarter wavelength ($\lambda_g/4$) of the microwave radiation of the operating frequency and serve to reduce any losses caused by any mismatch of the semiconductor material. While the antireflection element 40 only needs to be translucent for the microwave radiation, the antireflection layer 42 additionally needs to be translucent for the light 36 emitted by the light source 34.

Generally, it has shown that 20% of the width of the waveguide 20 is a reasonable size for the width of the semiconductor element 32. In this way the overall power can be reduced by approximately 80%. Generally, the width of the semiconductor element 32 is in the range from 5% to 50%, in particular from 10% to 30% of the width w of the waveguide 20.

The opening 25 of the end portion 24 of the waveguide 20 preferably takes at a portion of 5% to 75%, in particular of 10% to 50%, of the total end area of the second end portion 24. The size of the opening 25 depends on the type of application of the antenna array. If the antenna array 12 shall be used a reflectarray the opening 25 must not be too large so that microwaves transmitting through the semiconductor element 32 in the non-illuminated state are reflected at the back end wall 30 and are not completely transmitted through the waveguide 20.

If, however, the antenna array 12 shall be used as a transmissive array a waveguide-to-microstrip transition and a microstrip-to-waveguide transition are employed (see the embodiment depicted in FIG. 7E that will be explained below). Then, in one state the microwaves are reflected or absorbed by the semiconductor element 32 placed in the microstrip line. In this case only 50% of the energy is transmitted, i.e. the antenna aperture efficiency is reduced by 50%.

In another embodiment, said opening 25 is covered by a light transmissive layer (not shown), such as an indium tin oxide (ITO) layer, provided at the second end portion 24 through which the light 36 emitted from the light source 34 is transmitted onto the semiconductor element 32. The ITO layer reflects the microwaves, i.e. it is a conductor for microwaves and translucent for optical light. Further, the ITO layer covers the complete area of the second end 24, i.e. no back end wall 30 is required, but an optically translucent carrier material is used. This material is outside the waveguide and in front of the light emitting element.

Figure 6:
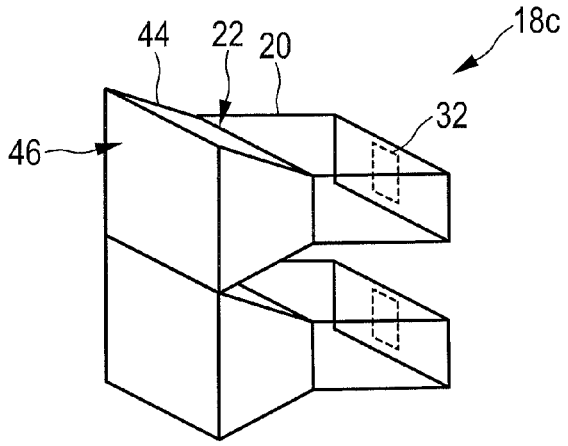
FIG. 6 shows a perspective view of a third embodiment of a single antenna element.

Another embodiment of an antenna element 18*c* is depicted in a perspective view in FIG. 6 (showing two of such antenna elements 18*c*). In this embodiment an aperture element 44, for instance a symmetric quadratic pyramidal aperture, is arranged in front of the first end portion 22 of the waveguide 20 having a larger aperture 46 than the first end portion 22 of the waveguide 20. By this aperture element 44 the incident microwaves are guided into the waveguide 20 having a smaller cross-section so that the semiconductor element 32 can also be made smaller than in the embodiment of the antenna element 18*a*, shown, for instance, in FIG. 3. Consequently, less optical power is required to illuminate the semiconductor element 32 to switch its state of reflectivity so that in total the optical power can be further reduced up to 90% compared to known optically controlled microwave antennas.

FIG. 7 shows a fourth fifth and sixth embodiment of an antenna element according to the present disclosure in different views. FIGS. 7A to 7C show the fourth embodiment of an antenna element 18*d* in a perspective view (FIG. 7A), a front view (FIG. 7B) and a side view (FIG. 7C). In this embodiment the waveguide 20 comprises a waveguide-to-microstrip transition 21 including a conducting ridge 49. Further, a microstrip line 48 is coupled to the waveguide-to-microstrip transition 21. In said microstrip line 48 the semiconductor element 32 is arranged in the vicinity of the second end portion 24. Said semiconductor element 32 is sandwiched between antireflection layers 40, 42 of $\lambda/4$ width which reduce the losses. The solid metal ridge 49 of width $\lambda/5$ to $\lambda/50$ is arranged in the waveguide-to-microstrip transition 21 to convert the waveguide mode to the quasi-TEM mode of the microstrip line 48. In this way the total size of the semiconductor element 32 can be made rather small requiring only a low optical power to change its state of reflectivity.

In this embodiment an antireflex layer of thickness $\lambda_g/4$ is needed on both sides of the semiconductor. The semiconductor can be illuminated from the top, back or bottom (as partly illustrated in FIG. 7C by the light beam 36), where an optically translucent ITO layer 45 is needed. Alternatively, the semiconductor can be optically illuminated from the side avoiding any ITO layer. In case the semiconductor is illuminated from the back side, the antireflex layer 47' pointing to the back short (i.e. the second end portion 24) is made of an optically translucent material and the back short is realized using an ITO layer 45.

Figure 7A:
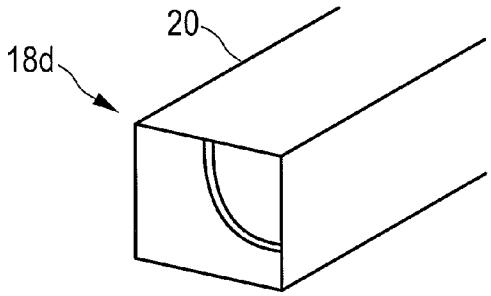
FIG. 7A-7E show a fourth, fifth and sixth embodiment of a single antenna element according to the present disclosure in different views.
Figure 7B:
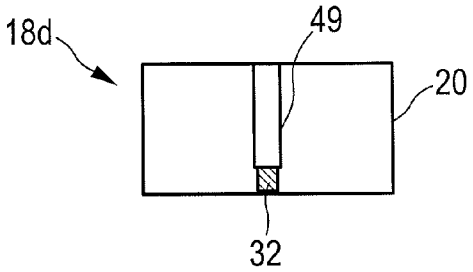
Figure 7C:
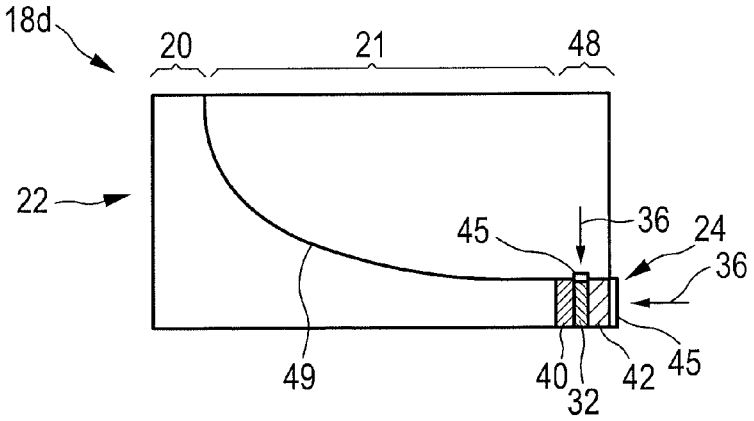
Figure 7D:
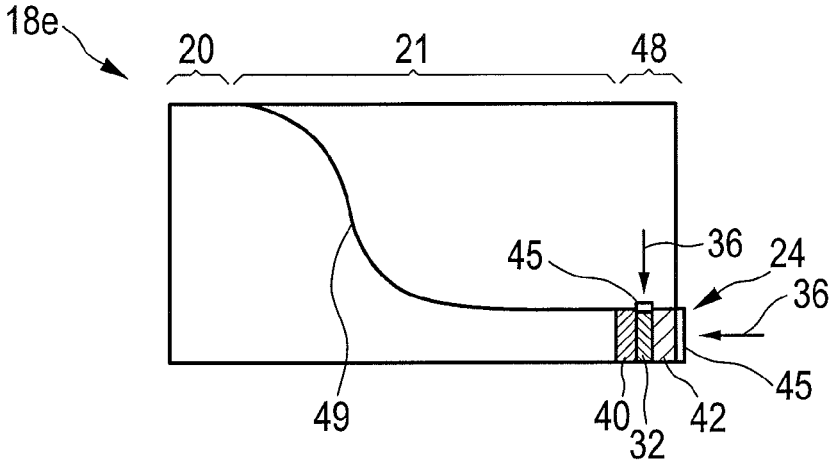

FIG. 7D shows the fifth embodiment of an antenna element 18*e* in a side view. Basically, the same elements are used in this embodiment as in the fourth embodiment of the antenna element 18*d*, but the ridge 49 has a different form here in this embodiment. This fifth embodiment has a smoother transition, which results in a better matching than the fourth embodiment shown in FIG. 7C. However, there are many possibilities for such waveguide-to-microstrip transitions.

Figure 7E:
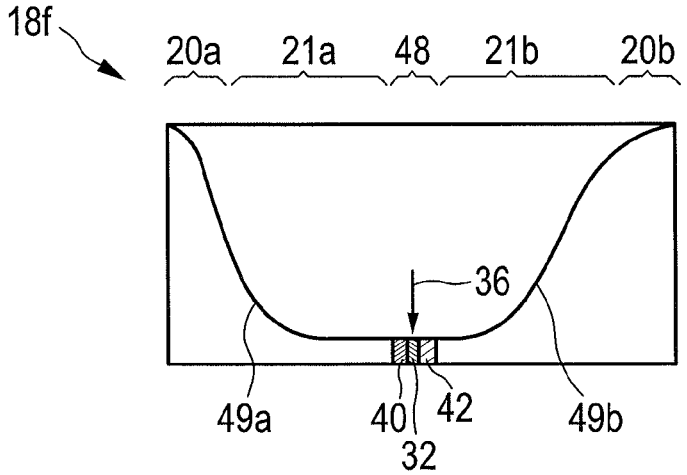

FIG. 7E shows a sixth embodiment of an antenna element 18*f*. In this embodiment the antenna element 18*f* is used in transmissive operation. The antenna element 18*f* comprises a microstrip line 48, which is arranged between a waveguide-to-microstrip transition 21*a* and a microstrip-to-waveguide transition 21*b*, each including a ridge 49*a*, 49*b*. The transitions 21*a*, 21*b* are coupled to waveguides 20*a* and 20*b*, respectively, which have open ends as input and output, respectively. The semiconductor element 32 is placed in the microstrip line 48 and can be illuminated from the top, bottom, or side. If it is illuminated, it can either absorb or reflect the incident microwave radiation, whereas if it is not illuminated, the microwave signal can pass through. To reduce the mismatch between air and the semiconductor material antireflection layers 40, 42 of $\lambda_g/4$ width are provided on both sides of the semiconductor element 32.

Figure 8:
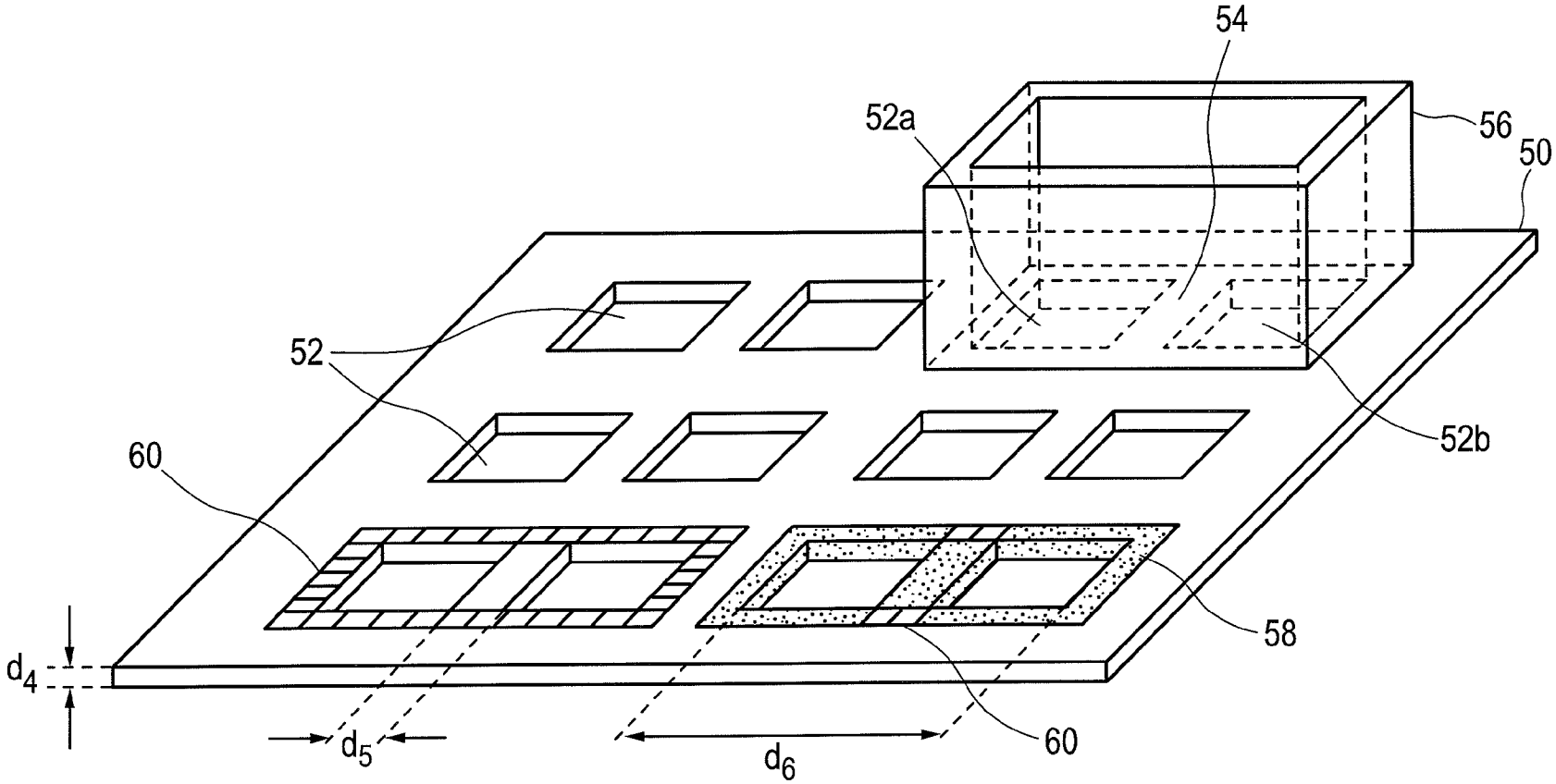
FIG. 8 shows a second embodiment of an antenna array according to the present disclosure.

A preferred embodiment for manufacturing an antenna array 12 shall be illustrated by way of FIG. 8. This figure depicts a grid 50 made of semiconductor material, in particular made of Si. In said grid 50 holes 52 have been formed, in particular by etching, wherein between two neighboring holes 52*a*, 52*b* a post 54 of said semiconductor material remains, said post 54 representing the semiconductor element 32. Onto said grid 50, preferably on both sides, the waveguides 20 are formed by an array of tubes or tube-like structures having two open ends, wherein said array of tubes is coupled to said grid 50 and arranged such that an open end of a tube 56 covers two neighboring holes 52*a*, 52*b* and the post 54 formed there between.

In an exemplary implementation for 140 GHz the thickness $d_4$ of the grid 50 may be approximately 50 μm, the width $d_5$ of the post 54 may be approximately 300 μm and the width $d_6$ of the two neighboring holes 52*a*, 52*b* including the post 54 may be approximately 1500 μm. Further, in an embodiment a conductive coating 58, e.g. made of gold, may be provided at the inner sidewalls of said holes 52*a*, 52*b* to further improve the ability to guide microwaves within said holes 52*a*, 52*b*. This is only exemplarily shown for two neighboring holes. Further, in an embodiment vias 60 are provided at the top and bottom of the post 54 to continue the walls of the rectangular waveguides 56 put on the top and bottom of the semiconductor grid 50. Instead of using a metal plating, the entire outline of the waveguide can be covered with vias as depicted exemplarily in FIG. 8.

Preferably, the light sources 34 of the antenna array 12 are also arranged in a light source matrix (not shown), in particular on a light source carrier structure. In an embodiment, said light source carrier structure can be easily coupled to the grid 50 and the light sources are arranged in said light source carrier structure with distances corresponding to the distances of the posts 54 in the grid 50.

Figure 9:
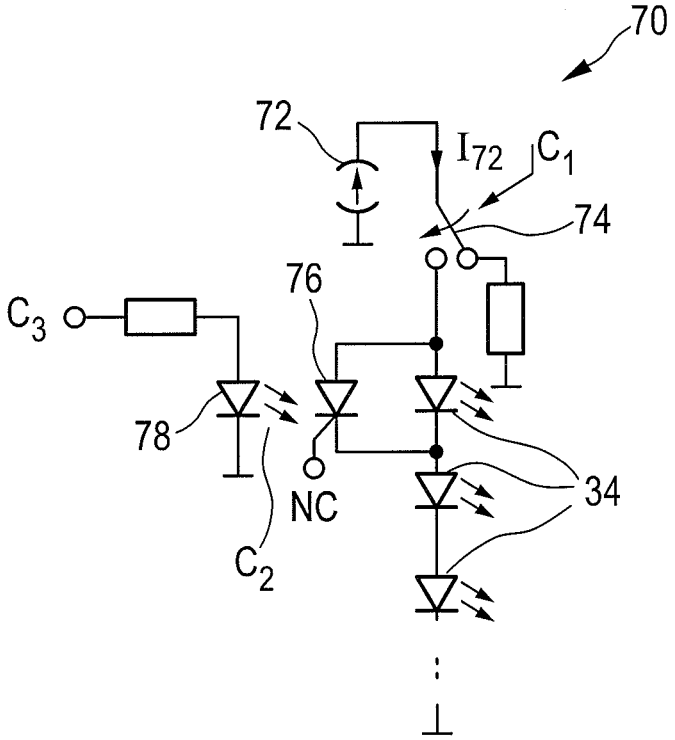
FIG. 9 shows a circuit diagram of a control unit for controlling a light source of an antenna element according to the present disclosure.

An array of a large number, e.g. 10000, antenna elements (covering, for instance, an area of 10 cm×10 cm at an operating frequency of 140 GHz) requires a large number of control lines if the light sources 34 were individually controlled to illuminate the respective semiconductor elements 32. In principle, each semiconductor element 32 should be controlled individually. Connecting each light source 34 of a light source matrix to an output of a control circuit, such as a microcontroller or FPGA, would result in a high overall current consumption which cannot be handled by the control circuit. Thus, according to an aspect of the present disclosure a control circuit is provided for controlling light sources of an antenna array, in particular an antenna array as proposed according to the present disclosure, of a microwave antenna, in particular as proposed according to the present disclosure. A circuit diagram of a single control unit 70 of such a control circuit is shown in FIG. 9. As shown in the circuit diagram the light sources 34 within a row or column are connected in series and are driven by a current source 72 that, for instance, provides a drive current $I_{72}$ of 10 mA. Said drive current $I_{72}$ can be switched on and off by use of an electronic switch 74 which is switched on and off under control of a first control signal $C_1$ (also called line control signal). By coupling the light sources 34 within a row or column in series and driving them by the common current source 72 the overall current can also be reduced.

In parallel to the individual light sources 34 a switchable element 76 is provided that can be switched on and off under control of a second control signal $C_2$ (also called switching element control signal). When said switchable element 76 is switched on, the light source 34 coupled in parallel is shorted so that the light source 34 is switched off, i.e. does not emit light. The switchable element 76 is preferably formed by a thyristor or a triac, in particular a photo-thyristor or photo-triac.

The second control signal $C_2$ is provided by a switching element 78 which is configured for switching said switchable element 76 on and off. Preferably, said switching element 78 is formed by a diode, in particular an IR diode, and the second control signal $C_2$ is a radiation signal emitted by said diode 78. Said switching element 78 in turn is controlled by a third control signal $C_3$, e.g. provided by a microcontroller or a processor.

Assuming in a practical implementation a voltage drop of 1 to 4 V at each light source 34, the voltage at the top light source of a row or column can sum up to a few 100 volts. A photo-thyristor used as the switchable element 76 allows simple voltage level shifting without a galvanic connection to the control circuitry controlling the switching element 78 running at low voltage. Once switched on, the switchable element 76 remains switched on until the supply current $I_{72}$ is turned off for which purpose the switch 74 is provided which switches the entire row or column on and off.

Figure 10:
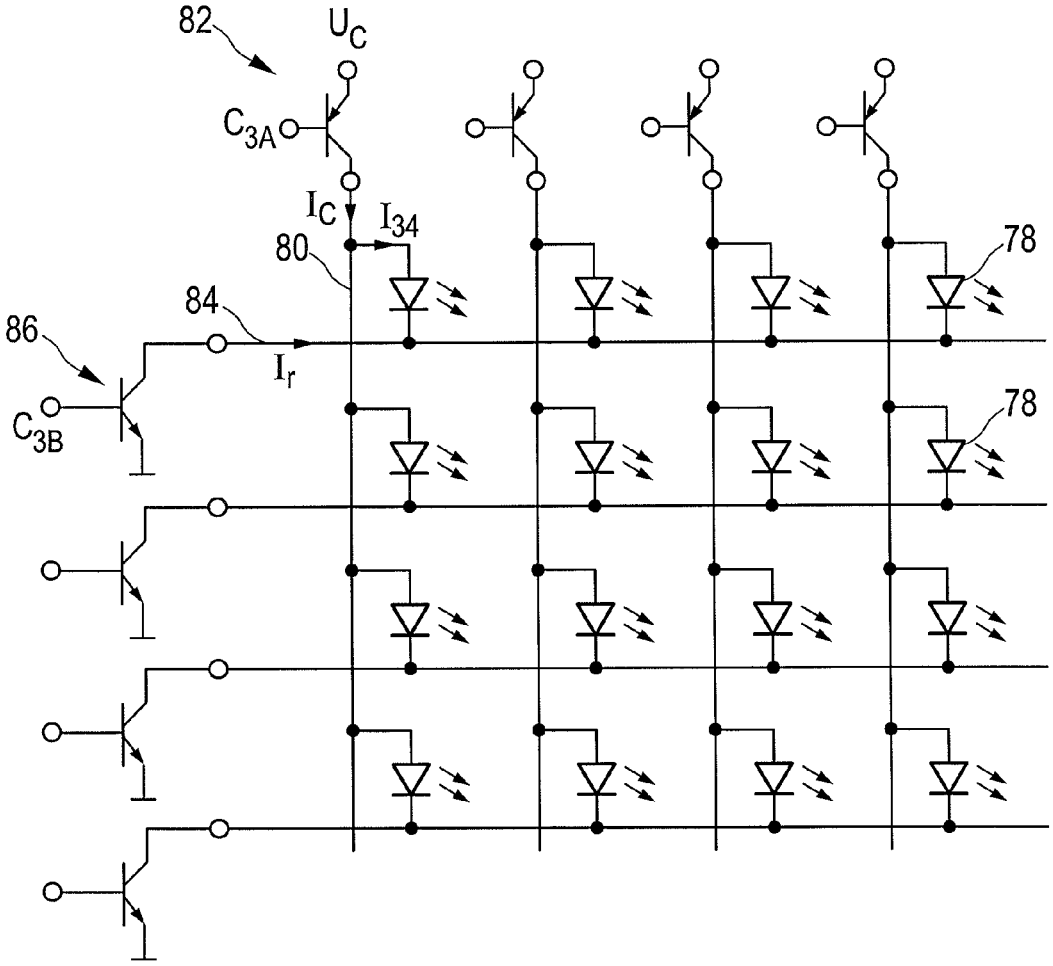
FIG. 10 shows an embodiment of a control circuit according to the present disclosure for controlling the light sources.
Figure 11:
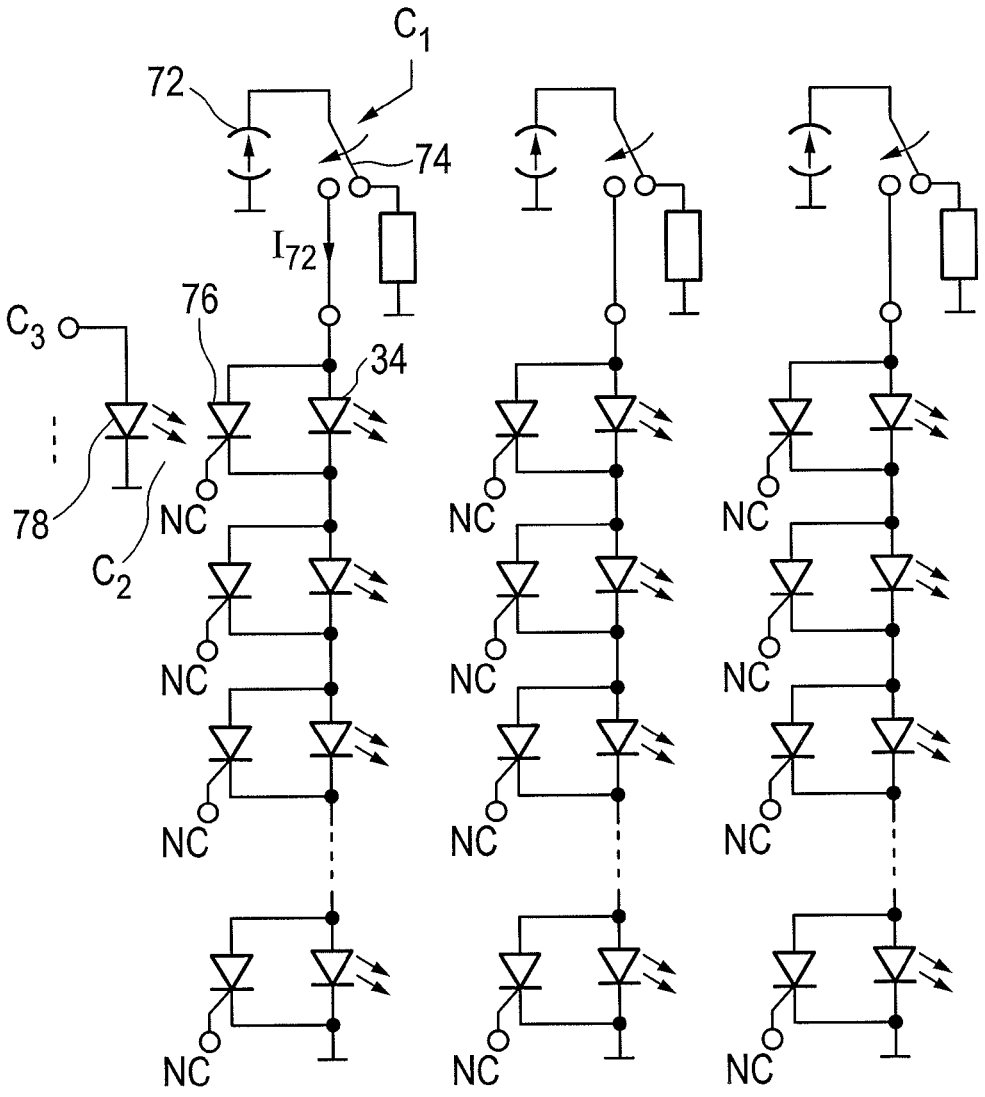
FIG. 11 shows an embodiment of a control circuit according to the present disclosure for controlling switchable elements coupled in parallel to said light sources.

More details of the proposed control circuit are shown in the circuit diagrams depicted in FIGS. 10 and 11. FIG. 10 shows particularly the control circuitry for providing the light sources 78 with the required optical control signals. As shown in FIG. 10 an array of, for instance, 100×100 light sources 78 are provided as light source matrix, i.e. an array of rows and columns, each light source 78 covering, for instance, an area of 1.5 mm×1.5 mm (at 140 GHz) at maximum. For each column a column control line 80 is provided. To each column a column drive current $I_c$ of e.g. 500 mA is provided through a column switch 82 (e.g. a bipolar transistor) from a voltage source (not shown) providing a column voltage $U_c$ of e.g. 1.5 V. Said column switches 82 are controlled by column control signals $C_{3A}$. Thus, a light source current $I_{34}$ of e.g. 5 mA runs through each light source 78. Further, row control lines 84 are provided through which a row drive current $I_r$ of e.g. 5 mA is fed through a row switch 86 (e.g. a bipolar transistor) which is controlled by a row control signal $C_{3B}$.

FIG. 11 shows the control circuitry for controlling the switchable elements 76 through the switching elements 78 as explained above with reference to FIG. 9. As explained above a single switchable current source 72 drives each column of light sources 78. However, in an embodiment a single current source and a multiplexer can be used for all columns. For each switchable element 76 a switching element 78 controlled by a third control signal $C_3$ is provided.

Considering a particular implementation, FIG. 10 shows a matrix of LEDs 78, which are used to control the photo-thyristors 76. Using a matrix structure reduces the number of outputs of a microcontroller used to configure the matrix. FIG. 11 shows the columns of laser diodes 34 used to illuminate the semiconductor elements. Using a column arrangement can reduce the overall current and the wires used for interconnections. The LEDs 78 control the photo-thyristors 76, which in turn switch the laser diodes 34 on and off. Configuration of the entire array requires a sequential setup of all columns.

Figure 12:
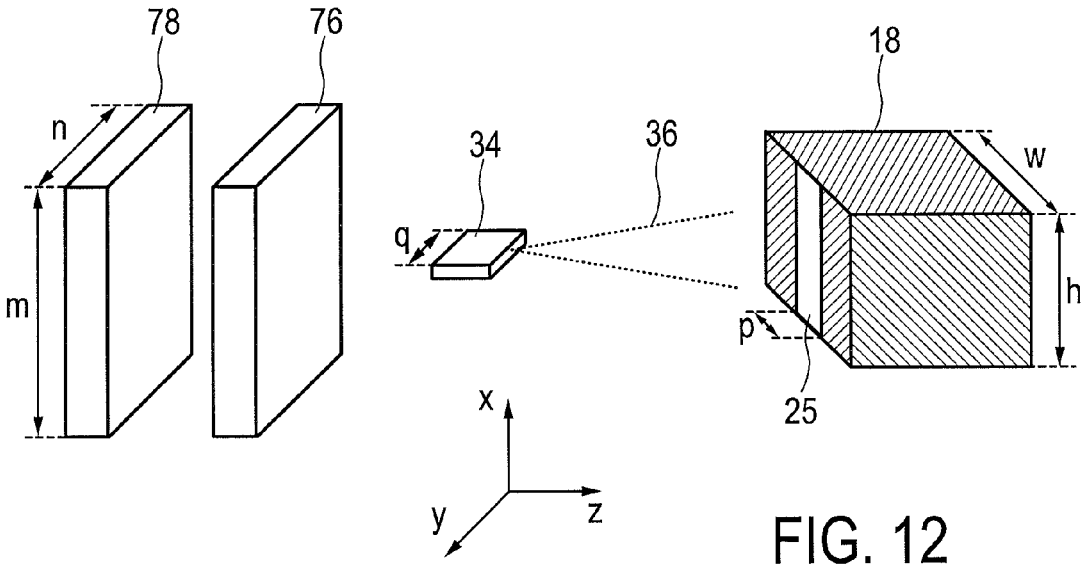
FIG. 12 shows a perspective view of the arrangement of the components of the control unit as shown in FIG. 9.

FIG. 12 schematically shows the arrangement of main components of the control unit 70 shown in FIG. 9. In particular, a light source 34 for emitting a light beam 36 through the opening 25 in the antenna 18 is shown as a side radiating laser diode. Further, the switching element 76 in the form of a photo-thyristor or triac is shown arranged next to the light source 34. The switching element 78, e.g. an IR diode, is arranged next to the switchable element 76. These components are stacked in z-direction and have a maximum size m×n of 1.5 mm×1.5 mm in x-y-direction (typically a size of 1 mm×1 mm) for an operating frequency of 140 GHz, just to give an example. The laser diode 34 has, for instance, a width q of 0.5 mm and the opening 25 has, for instance, a width p of 0.5 mm. The antenna element 18 has, for instance, a height h of 0.75 mm and a width w of 1.5 mm.

Figure 13:
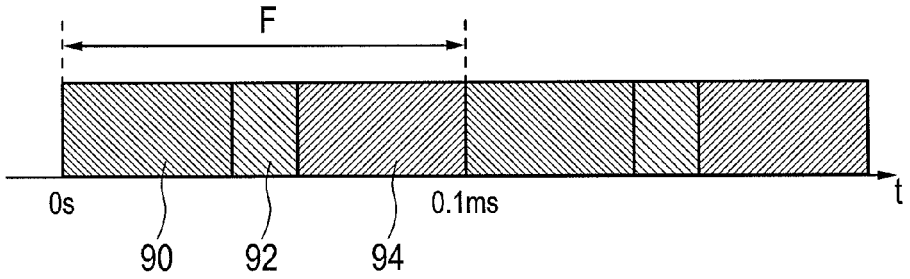
FIG. 13 shows a timing diagram illustrating the control of the light sources according to the present disclosure.

For proper operation a special control sequence is preferably used as is schematically depicted in the timing diagram of FIG. 13. Said control sequence is also referred to as a frame F. Considering the use of the proposed antenna in an imaging device for imaging a scene, the acquisition of one pixel of an image to be taken starts with a reset phase 90. During this reset phase 90 all switches 74 of all columns/rows are switched off, so that all light sources are switched off. Then, the switches 74 are turned on sequentially and in the setup phase 92 all columns/rows are configured sequentially by the control circuit, which limits the current through the control circuit. For this setup phase a switching element 78 is briefly switched on so that the corresponding light source is briefly switched off. When all light sources or columns/rows are configured, the measurement phase 94 can start during which all light sources have the desired state and the desired data, e.g. for one pixel, can be acquired.

Figure 14:
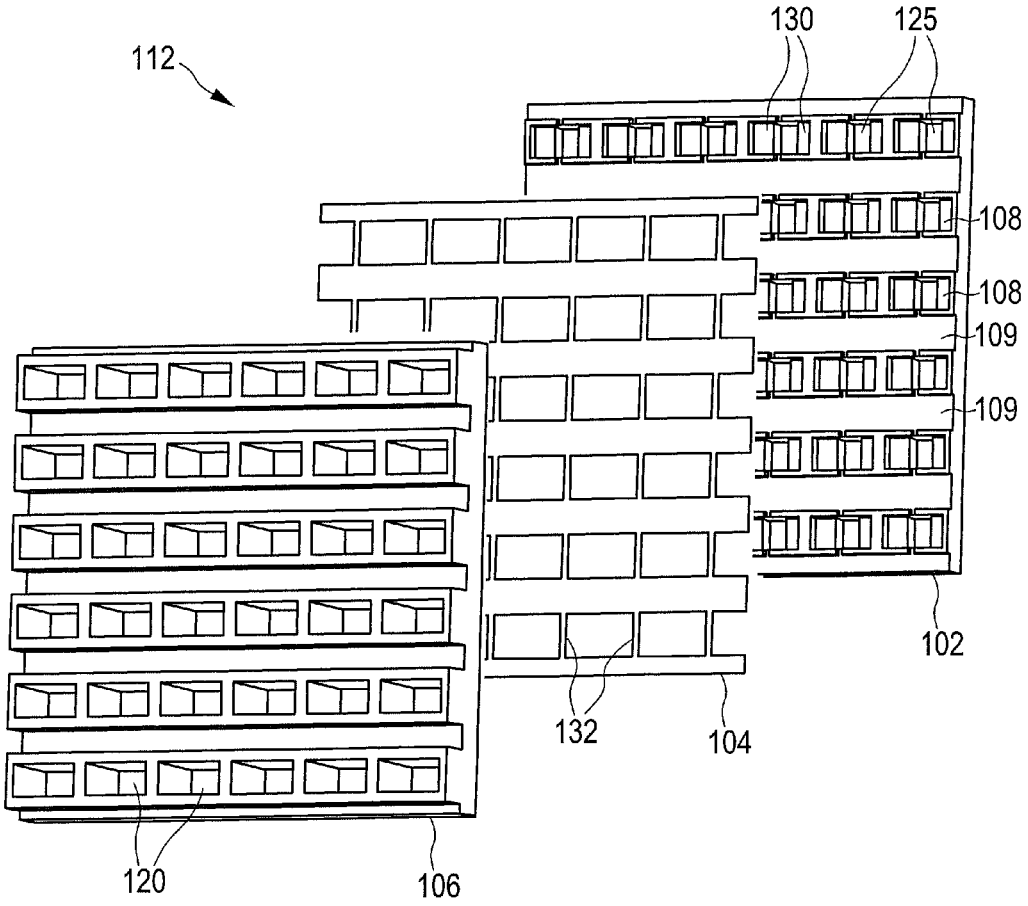
FIG. 14 shows an explosive view of a third embodiment of an antenna array according to the present disclosure.
Figure 15:
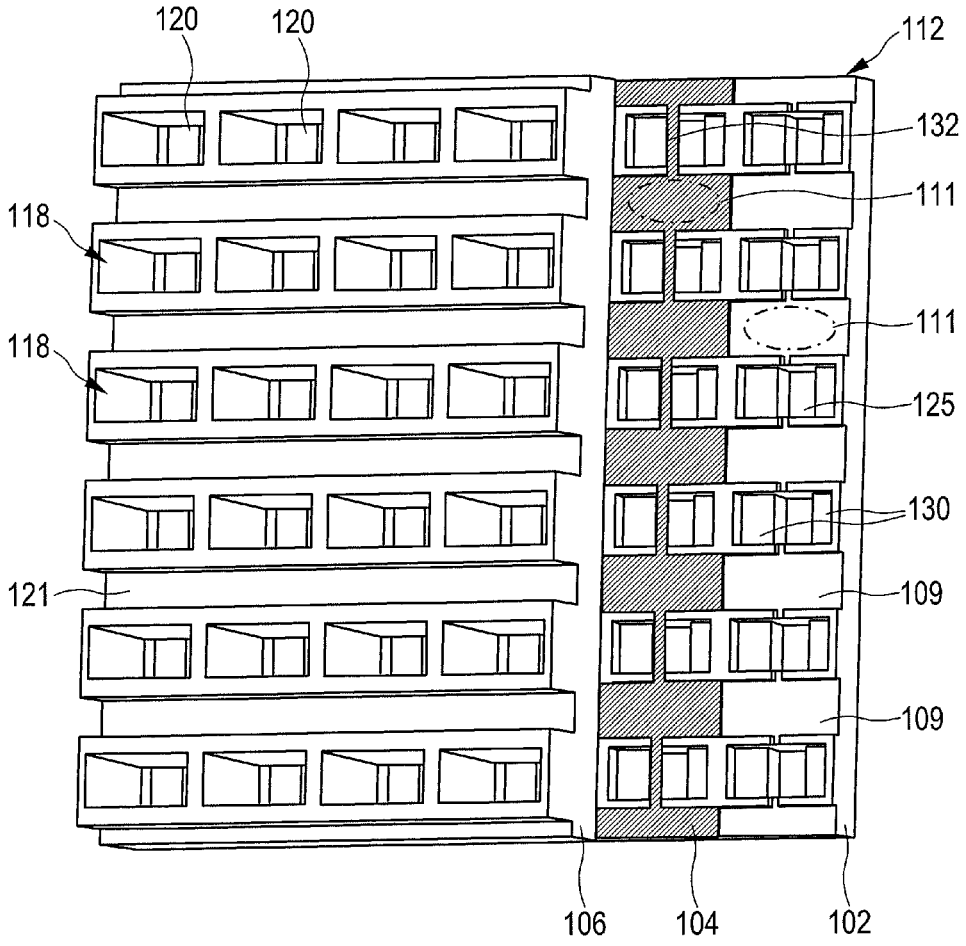
FIG. 15 shows a perspective front view of the third embodiment of an antenna array according to the present disclosure.

FIG. 14 shows an explosive view of a third embodiment of an antenna array 112 according to the present disclosure, and FIG. 15 shows a perspective front view of the third embodiment of the antenna array 112 comprising a plurality of antenna elements 118 (the illumination element is not shown). This embodiment provides the advantage that it can be fabricated with high repeatability and high accuracy. Furthermore, the fabrication process is less complex and less expensive, at least for a realization at 140 GHz, than it might be for the first and/or second embodiments of the antenna array.

The antenna array 112 comprises a back short layer 102, a center layer 104 and a top layer 106. The back short layer 102 comprises an array of rectangular waveguides 108 having depths in the order of a quarter guided wavelength. Furthermore it contains a narrow hole 125 within the center of the shorted waveguide between the back end walls 130. Said hole 125 is used to illuminate the photosensitive (semiconductor) element 132 using an optical light source (not shown) from the back side.

The back short layer 102 further contains a structure to inlay the thin center layer 104 made of a semiconductor material. The vertical stripes 132 of the center layer are the photosensitive elements, which are placed in the center of the waveguide 108 and by proper illumination causing a phase change of 180°.

The antenna aperture is made up of the top layer 106, which is placed on top of the center layer 104. This top layer 104 contains rectangular open-ended waveguides 120, which are preferably spaced 0.5 to 0.8λ in horizontal as well as vertical direction. The vertically stacked lines of waveguides 120 are separated by horizontal grooves 121. These grooves 121 are used to decouple the individual antenna elements 118. In vertical direction such grooves may also be provided, but are generally not required since there is generally no (or only negligible) coupling in vertical direction (due to the rectangular waveguide fed antenna elements used).

Typically the three layers 102, 104, 106 are glued together within the area of horizontal channels 109 of the back short layer 102. If desired adhesive for gluing the layers 102, 104, 106 may be used in areas 111 for adhesive. The adhesive may be fluid or a thin tape, which is fit into the channels.

The back short layer 102 and the top layer 106 are preferably made of silicon or metalized silicon. The central layer 104 is made of intrinsic or slightly doped silicon, generally without requiring any additional conductive coatings made e.g. of gold as shown in FIG. 8.

Figure 16:
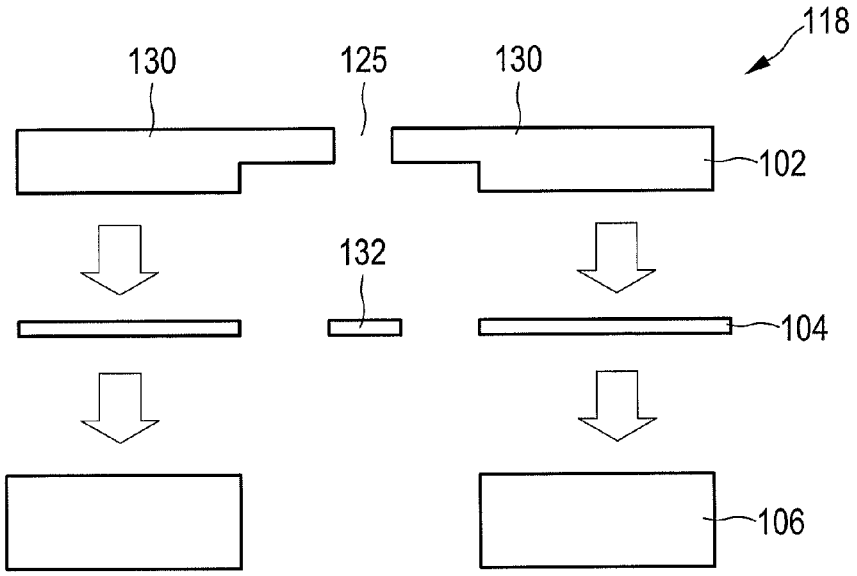
FIG. 16 shows an explosive cross sectional view of a seventh embodiment of an antenna element as used in the third embodiment of an antenna array.
Figure 17:
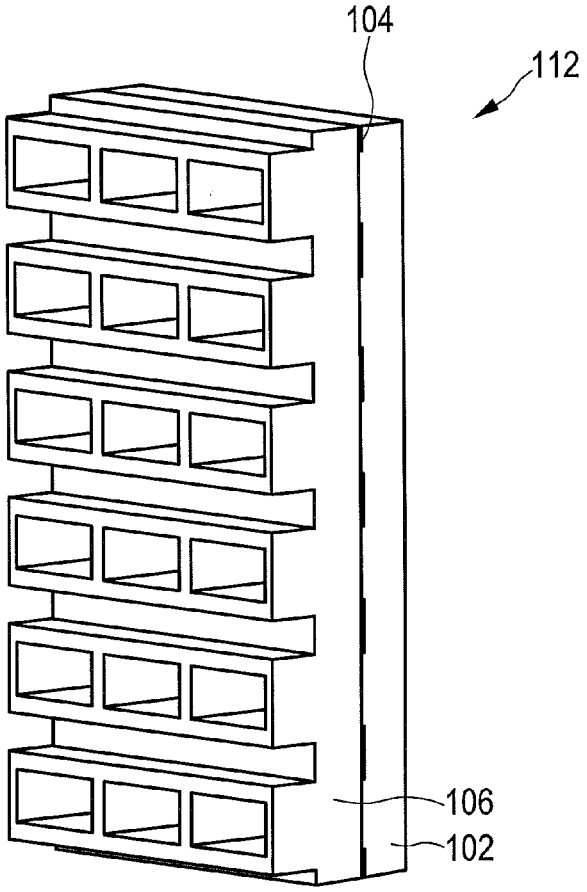
FIG. 17 shows another perspective cross sectional front view of the third embodiment of the antenna array according to the present disclosure.
Figure 18:
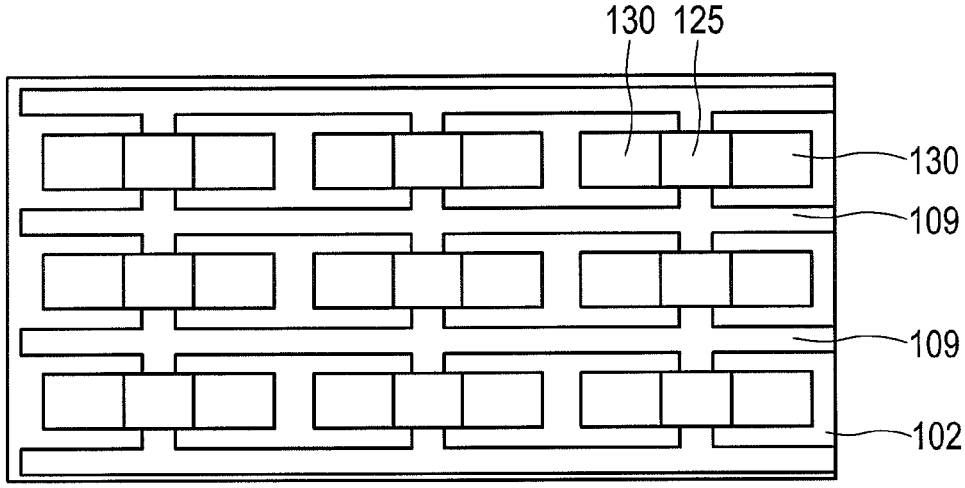
FIG. 18 shows front view of a back short layer of the third embodiment of the antenna array according to the present disclosure.

FIG. 16 shows an explosive cross sectional view of a seventh embodiment of an antenna element 118 as used in the third embodiment of an antenna array 112, FIG. 17 shows another perspective front view of the third embodiment of an antenna array 112, and FIG. 18 shows a front view of the back short layer 102. Some exemplary dimensions for an operating frequency of 140 GHz are: Thickness of back short layer 102: 700 μm; thickness of center layer 104: 50 μm; thickness of front layer 106: 1000-1500 μm; width of semiconductor element 132: 130 μm; width of horizontal groove 121: 450 μm; depth of horizontal groove 121: 700 μm.

Figure 19:
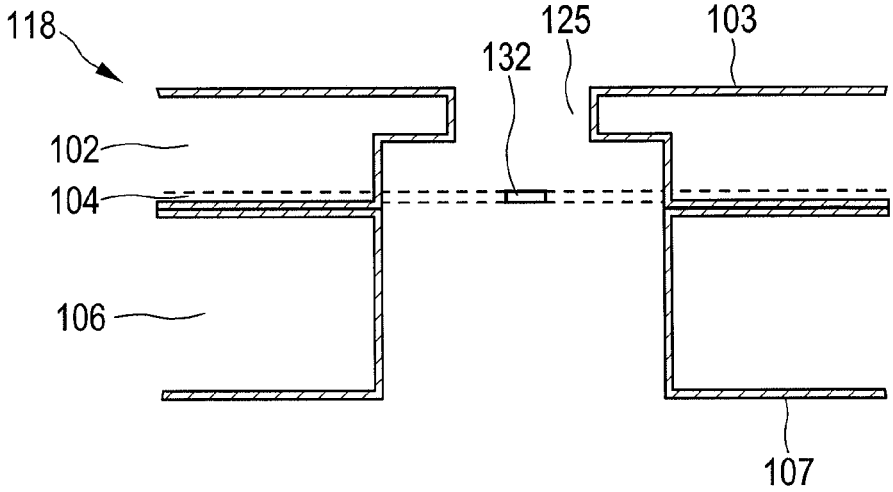
FIG. 19 shows a cross sectional view of the seventh embodiment of an antenna element as used in the third embodiment of an antenna array.

For a practical realization, a stack of planar silicon wafers can be fabricated. The waveguide structure 108 and the channels 109 for the inlay of the thin silicon center wafer 104 can be etched out of a thick wafer. The surface of the wafers is preferably metalized, i.e. carry a thin metal layer 103 as illustrated in the cross sectional view of the seventh embodiment of the antenna element 118 shown in FIG. 19. The top and bottom layers 106 and 102 can alternatively also be manufactured from metal by micromachining or laser machining or it can be a molded part which is conductive or metalized on its surface by a thin metal layer 107.

Figures 20A, 20B, 20C:
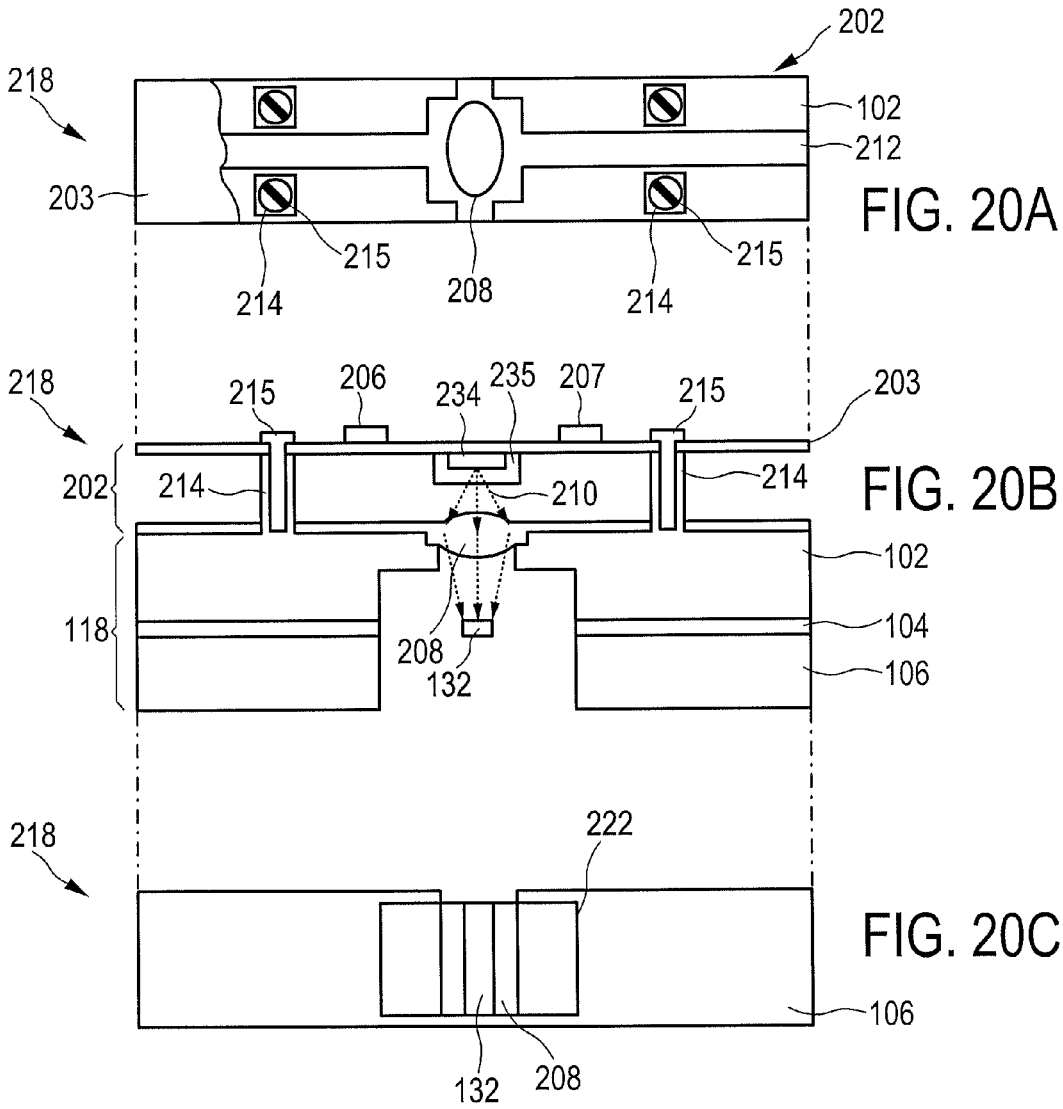
FIG. 20A-20C show different views of a fourth embodiment of an antenna array according to the present disclosure.

In order to properly illuminate the photosensitive bar, i.e. the semiconductor element 132, particularly for an antenna array 112 as shown in FIGS. 14 to 19, an optical system is employed, which is generally located on the back side of the antenna array 118. FIG. 20 shows an antenna element 218 of a simple embodiment of an antenna array, wherein FIG. 20A shows a back view of only the illumination unit 202, FIG. 20B shows a cross sectional top view and FIG. 20C shows a front view. The illumination unit 202 of this embodiment of the antenna comprises a printed circuit board (PCB) 203 carrying a top radiating LED 234 and some control logic 206 and/or other required electronics 207. On top of the LED 234 (preferably with polymer coating 235) a lens 208 is placed, which focuses the optical beam 210 onto the photosensitive bar 132. The lens 208 can be a molded structure forming a grid 212 for the whole array. The illumination unit 202 is coupled to the front part of the antenna element, which may correspond to the part of the antenna element 118 shown in FIGS. 14 to 19, by use of posts or distance elements 214 and e.g. screws 215. In FIG. 20C the waveguide opening 222 can be seen.

Figures 21A, 21B, 21C:
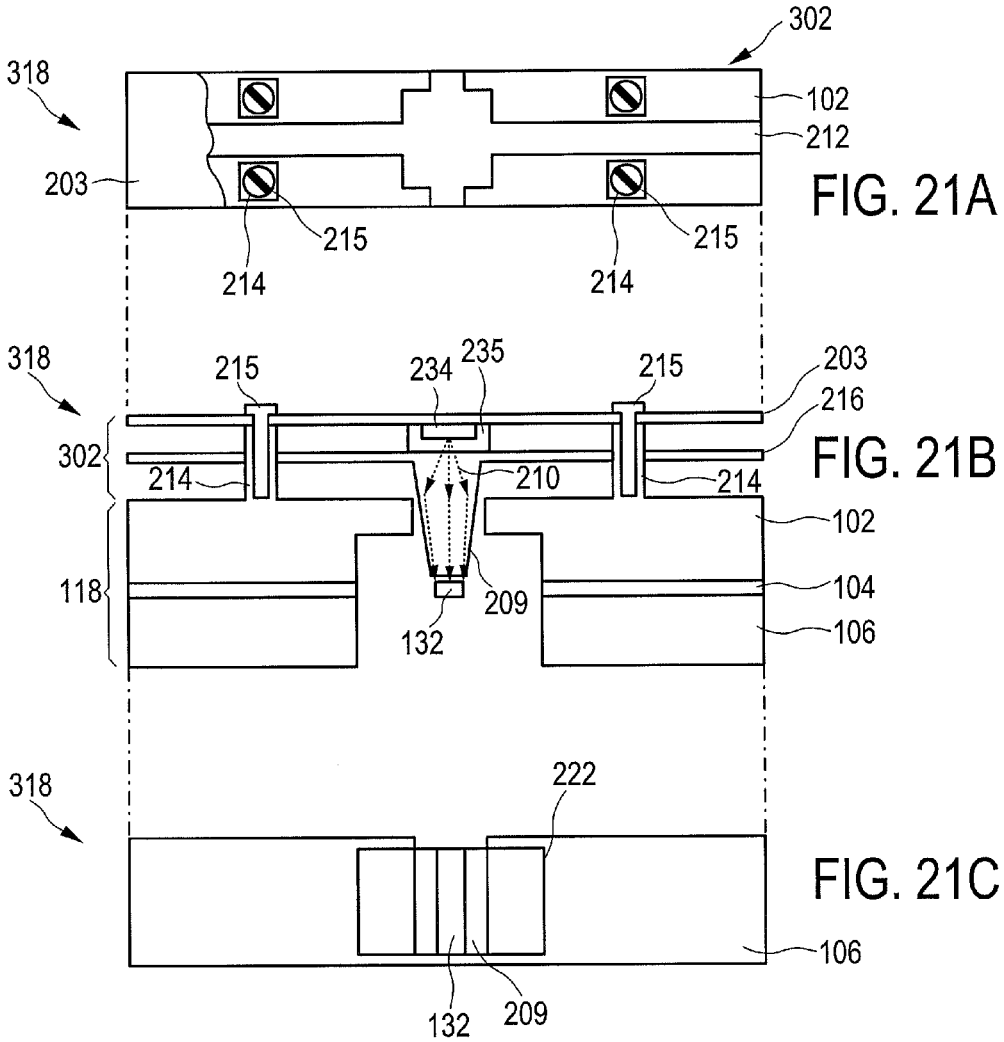
FIG. 21A-21C show different views of a fifth embodiment of an antenna array according to the present disclosure.

FIG. 21 shows an antenna element 318 of another embodiment of an antenna array, wherein FIG. 21A shows a back view of only the illumination unit 302, FIG. 21B shows a cross sectional top view and FIG. 21C shows a front view. In this embodiment a dielectric rod 209 is used as optical guide to focus the optical beam 210 onto the center bar 132. Such a rod 209 can be molded from a polymer and should end at a short distance before the photosensitive element 132. If they do not touch, mechanical stress can be reduced. The dielectric rod 209 is held in this embodiment by a grid or holding bars 216. Further, the LED 234 and polymer coating 235, respectively, may be glued to the end of the dielectric rod 209 In general, a solution with an optical guide has a higher efficiency than a solution using a lens as shown in FIG. 20. Generally any kinds of optical waveguides may be used as rod 209.

Figures 22A, 22B, 22C:
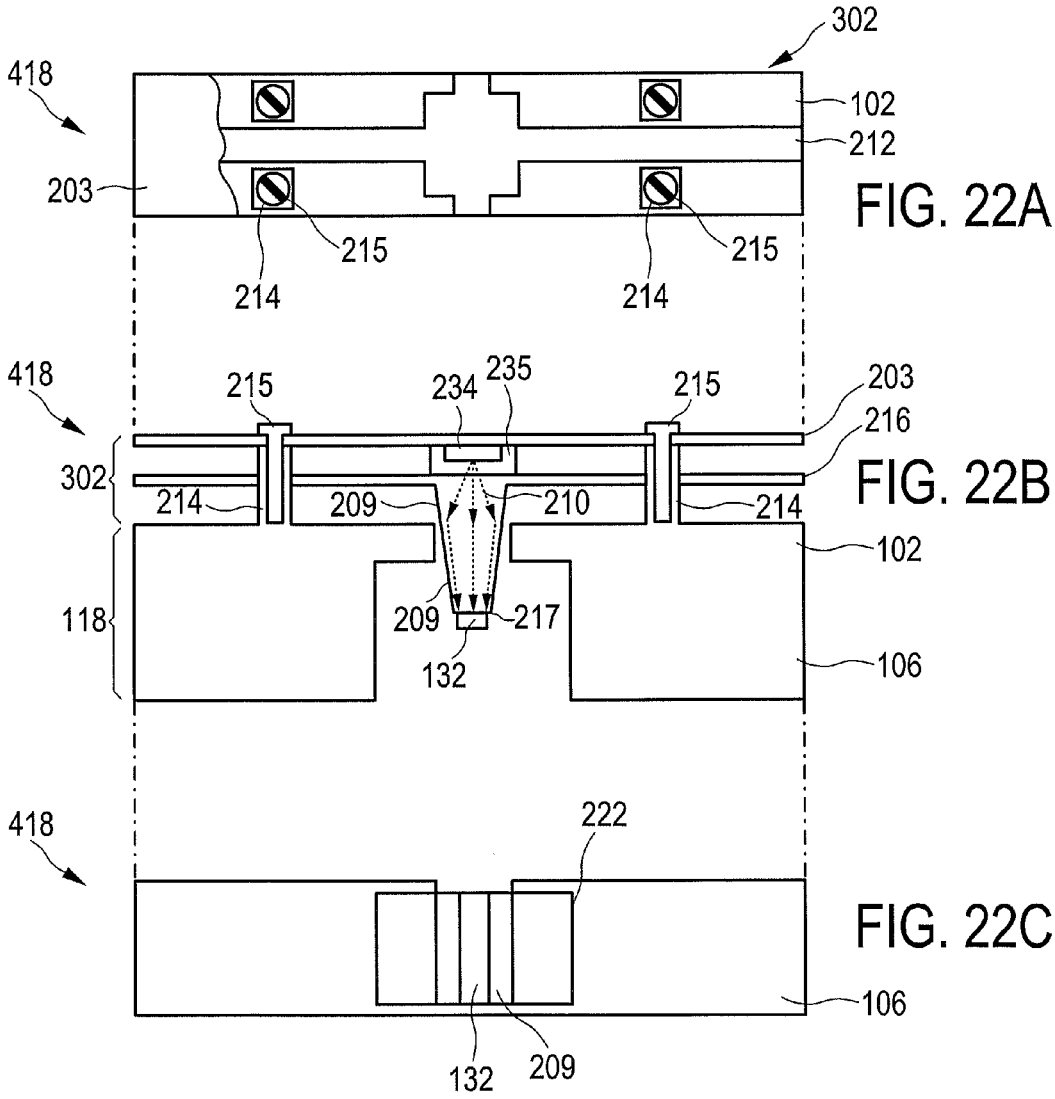
FIG. 22A-22C shows different views of a sixth embodiment of an antenna array according to the present disclosure.

FIG. 22 shows an antenna element 418 of still another embodiment of an antenna array, wherein FIG. 22A shows a front view of only the illumination unit 302, FIG. 22B shows a cross sectional top view and FIG. 22C shows a front view. In this embodiment the entire antenna structure is fabricated out of a single layer. There is no center layer 104. Thus, the photosensitive bars 132 are diced rectangular chips, which are glued with optically translucent adhesive to the tip 217 of the dielectric rod 209. The rod 209 thus has two functions: it must mechanically hold the photosensitive element 132 and it must guide the optical light 210 from the light source 234 to the photosensitive element 132. The antenna structure can be fabricated out of any material, which is electrically conductive or has a conductive coating.

In summary, according to the present disclosure an optically controlled microwave antenna, in particular a plasmonic reflectarray antenna, is provided in which the reflection (or transmission) of the antenna elements of an antenna array can be controlled by optical illumination of an intrinsic semiconductor which is placed inside an open ended waveguide and represents a reconfigurable short. The phase of the reflected (or transmitted) microwave signal of each semiconductor element can be controlled in a binary manner by switching between 0° and 180°. Compared to known optically controlled microwave antennas the proposed antenna requires approximately 80% to 90% less optical power and has lower losses, in particular below 1 dB. This is particularly achieved since the area which must be illuminated to control the single semiconductor elements is strongly reduced. Further, compared to known antennas comprising a bulk semiconductor, a well-defined radiation pattern can be achieved for each semiconductor element which is beneficial for the total antenna pattern.

Furthermore, according to another aspect of the present disclosure a control circuit is provided which reduces the overall current, allows simple voltage level shifting and has no static power consumption.

The invention disclosure can be applied in various devices and systems, i.e. there are various de-vices and systems which may employ an antenna array, an antenna and/or a control circuit as proposed according to the present disclosure. Potential applications include—but are not limited to—a passive imaging sensor (radiometer), a radiometer with an illuminator (transmitter) illuminating the scene to be scanned, and a radar (active sensor). Further, the present disclosure may be used in a communications device and/or system, e.g. for point to point radio links, a base station or access point for multiple users (wherein the beam can be steered to each user sequentially or multiple beams can be generated at the same time, interferers can be cancelled out by steering a null to their direction), or a sensor network for communication among the individual devices. Still further, the disclosure can be used in devices and systems for location and tracking, in which case multiple plasmonic antennas (at least two of them) should be employed at different positions in a room; the target position can then be determined by a cross bearing; the target can be an active or passive RFID tag). The proposed control circuit can be used to drive any electrical structure, which is arranged as an array, such as e.g. pixels of an LCD display, LEDs, light bulbs, elements of a sensor array (photo diodes).

The disclosure has been illustrated and described in detail in the drawings and foregoing description, but such illustration and description are to be considered illustrative or exemplary and not restrictive. The disclosure is not limited to the disclosed embodiments. Other variations to the disclosed embodiments can be understood and effected by those skilled in the art in practicing the claimed disclosure, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The present application claims priority of European patent application PCT/EP2011/073564 filed in the European Patent Office on Dec. 21, 2011, the entire contents of which being incorporated herein by reference.

The invention claimed is:

1. An optically controlled microwave antenna comprising:

i) an antenna array comprising a plurality of antenna elements, an antenna element comprising:

a waveguide for guiding microwave radiation at an operating frequency between a first open end portion and a second end portion arranged opposite the first end portion, said second end portion including a light transmissive portion formed in at least a part of the second end portion, an optically controllable semiconductor element arranged within the waveguide in front of the light transmissive portion of the second end portion, said semiconductor element changing its material properties, its reflectivity of microwave radiation of the operating frequency, under control of incident light, and a controllable light source arranged at or close to the light transmissive portion of the second end portion for projecting a controlled light beam onto said semiconductor element for controlling its material properties, or its reflectivity; and ii) a feed for illuminating said antenna array with and/or receiving microwave radiation of the operating frequency from said antenna array to transmit and/or receive microwave radiation.

2. The microwave antenna as claimed in claim 1, wherein said semiconductor element is configured to switch its material properties between a conductor and a dielectric causing a phase change of 18°, 118°, 218°, 318°, 4180° of the reflected microwave signal in the waveguide.

3. The microwave antenna as claimed in claim 1, wherein said semiconductor element is formed as a post arranged between, or contacting, two opposing sidewalls of the waveguide.

4. The microwave antenna as claimed in claim 3, wherein the width of said semiconductor element is in a range of from 5% to 50%, or from 10% to 30%, of the width of the waveguide.

5. The microwave antenna as claimed in claim 3, wherein said antenna element further comprises a support element configured to carry said semiconductor element and arranged adjacent to the semiconductor element between said opposing side walls.

6. The microwave antenna as claimed in claim 1, wherein said waveguide has a rectangular cross section having a width in a range of from 50% to 90% of the wavelength and a height in a range of from 25% to 40% of the wavelength of the microwave radiation of the operating frequency.

7. The microwave antenna as claimed in claim 1, wherein said semiconductor element is arranged at a distance from the second end portion of the waveguide of substantially a guided quarter wavelength of the microwave radiation of the operating frequency.

8. The microwave antenna as claimed in claim 1, wherein said light transmissive portion of the second end portion of a waveguide takes up a portion of 5% to 75%, or 10% to 50%, of a total end area of said second end portion.

9. The microwave antenna as claimed in claim 1, wherein said antenna element further comprises an antireflection element arranged on one or both sides of said semiconductor element and having a thickness of substantially a quarter wavelength of the microwave radiation of the operating frequency.

10. The microwave antenna as claimed in claim 1, wherein said antenna element further comprises an aperture element, or an aperture element of a pyramidal form or a form of a horn, arranged in front of the first end portion of the waveguide and having a larger aperture than the first end portion.

11. The microwave antenna as claimed in claim 1, wherein said antenna element further comprises a waveguide to microstrip transition and a microstrip line, wherein said semiconductor element is arranged in the microstrip line.

12. The microwave antenna as claimed in claim 1, wherein the semiconductor elements of said antenna array are formed in a grid made of semiconductor material, or made of Si, in which holes have been formed, or by etching, a post of said semiconductor material remaining between two neighboring holes representing a semiconductor element.

13. The microwave antenna as claimed in claim 12, wherein the waveguides of said antenna array are formed by an array of tubes having two open ends, said array of tubes being coupled to said grid such that an open end of a tube covers two neighboring holes and a post formed remaining said two neighboring holes.

14. The microwave antenna as claimed in claim 1, wherein said light source is formed by a laser diode or light emitting diode.

15. The microwave antenna as claimed in claim 1, wherein the light sources of said antenna array are arranged in a light source matrix, or on a light source carrier structure, said light source matrix comprising column and row control lines for individually controlling said light sources.

16. The microwave antenna as claimed in claim 1, further comprising a control circuit comprising a controller per light source or group of light sources for controlling the light sources of said antenna array, a controller comprising a switchable element coupled in parallel to said light source and a switching element for switching said switchable element on an off under control of a switching element control signal.

17. The microwave antenna as claimed in claim 16, wherein said switchable element is formed by a thyristor or a triac, or a photo thyristor, and wherein said switching element is formed by a diode, or an IR diode.

18. The microwave antenna as claimed in claim 15, wherein said control circuit further comprises a line switch per column or row of said light source matrix for switching a line current provided to a column or row of light sources coupled in series on and off under control of a line control signal.

19. The microwave antenna as claimed in claim 1, wherein said light transmissive portion is an opening.

20. The microwave antenna as claimed in claim 1 wherein said light transmissive portion comprises an indium tin oxide layer arranged in front of said light source.

21. The microwave antenna as claimed in claim 1, wherein said antenna array comprises a back short layer, a center layer, and a front layer placed above each other, said back short layer and said front layer forming said waveguides and said center layer forming said semiconductor elements.

22. The microwave antenna as claimed in claim 21, wherein said front layer comprises parallel grooves forming in its surface facing away from the center layer separating adjacent rows of openings of the waveguides.

23. The microwave antenna as claimed in claim 1, wherein the antenna element further comprises a light focusing element for focusing the light emitted by the light source to the semiconductor element.

24. The microwave antenna as claimed in claim 23, wherein said light focusing element comprises a lens or a dielectric rod.

25. The microwave antenna as claimed in claim 23, wherein the light focusing elements of the antenna array are formed as a molded lens structure fixed to the end portion of the waveguides between the end portion of the waveguide and the semiconductor elements.

26. The microwave antenna as claimed in claim 23, wherein said light focusing element comprises a dielectric rod that is fixed, or glued, at one end portion to the light source and/or at another end portion to the semiconductor element.

27. An antenna array, or for use in an optically controlled antenna comprising a plurality of antenna elements, an antenna element comprising:

a waveguide for guiding microwave radiation at an operating frequency between a first open end portion and a second end portion arranged opposite the first end portion, said second end portion having a light transmissive portion formed in at least a part of the second end portion, an optically controllable semiconductor element arranged within the waveguide in front of the light transmissive portion of the second end portion, said semiconductor element changing its material properties, or its reflectivity of microwave radiation of the operating frequency, under control of incident light; and a controllable light source arranged at or close to the light transmissive portion of the second end portion for projecting a controlled light beam onto said semiconductor element for controlling its material properties, or its reflectivity.

28. A control circuit for controlling light sources of an antenna array of a microwave antenna, said antenna array comprising a plurality of antenna elements, an antenna element comprising an optically controllable semiconductor element configured to change its material properties, or its reflectivity of microwave radiation of the operating frequency, under control of incident light, and a controllable light source for projecting a controlled light beam onto said semiconductor element for controlling its material properties, or its reflectivity, said control circuit comprising:

a controller per light source, a controller comprising switchable element coupled in parallel to said light source; and a switching element for switching said switchable element on an off under control of a switching element control signal.

29. An antenna array, or for use in an optically controlled antenna comprising a plurality of antenna elements, an antenna element comprising:

a waveguide for guiding microwave radiation at an operating frequency between a first open end portion and a second end portion arranged opposite the first end portion, said second end portion including an opening formed in at least a part of the second end portion;

an optically controllable semiconductor element arranged within the waveguide in front of the opening of the second end portion, said semiconductor element changing its material properties, or its reflectivity of microwave radiation of the operating frequency, under control of incident light;

a controllable light source arranged at a distance from the opening of the second end portion for projecting a controlled light beam onto said semiconductor element for controlling its material properties, or its reflectivity; and a light focusing element, or a dielectric rod and/or a lens, arranged between the light source and the semiconductor element through said opening for focusing the light emitted by the light source to the semiconductor element.

* * * * *